US005553992A

United States Patent [19]

Ashcroft

[11] Patent Number: 5,553,992

[45] Date of Patent: Sep. 10, 1996

[54] CONTROLS FOR A SKID STEER LOADER

[75] Inventor: Dale A. Ashcroft, New Holland, Pa.

[73] Assignee: New Holland North America, Inc., New Holland, Pa.

[21] Appl. No.: 328,311

[22] Filed: Oct. 24, 1994

[51] Int. Cl.[6] ..... E02F 3/34; E02F 9/20

[52] U.S. Cl. ..... 414/685; 74/471 XY; 74/479.01; 74/481

[58] Field of Search ..... 414/680, 685, 414/686, 689; 74/471 XY, 474.01, 480 R, 481, 414

[56] References Cited

U.S. PATENT DOCUMENTS

| | | | |
|---|---|---|---|
| 3,215,292 | 11/1965 | Hall . | |
| 4,140,144 | 2/1979 | Dowd | 414/685 |
| 4,398,861 | 8/1983 | Shimoie | 74/471 XY |
| 4,476,954 | 10/1984 | Johnson et al. | 74/471 XY |
| 4,526,204 | 7/1985 | Primdahl | 74/471 XY |
| 5,056,985 | 10/1991 | Johnson et al. | 74/481 |
| 5,186,295 | 2/1993 | Frisbee et al. | 74/480 R |
| 5,197,347 | 3/1993 | Moffitt et al. | 74/481 |
| 5,232,057 | 8/1993 | Renard | 74/471 XY |
| 5,360,312 | 11/1994 | Mozingo | 414/685 |
| 5,467,663 | 11/1995 | Trowbridge | 74/481 |

OTHER PUBLICATIONS

Sperry New Holland Publication No. 31653524–12–74 L.V.O. 1975, entitled "Sperry New Holland Utility Loaders"—p. 1 of the Specification, pp. 1–12.

*Primary Examiner*—Karen Merritt
*Assistant Examiner*—Gregory A. Morse
*Attorney, Agent, or Firm*—Frank A. Seemar; Larry W. Miller

[57] ABSTRACT

A skid steer loader having a main frame supported on four wheels and including a compartment in which an engine, hydraulic drive components and other elements are contained. A cab is mounted above the compartment on the main frame with side walls extending upwardly to define an operator control area therebetween. Supported on the frame is a boom structure including a pair of arms and a mounting assembly. The engine is operatively associated with the wheels for propelling the loader. The engine is also operatively associated with the boom structure for raising and lowering the pair of arms. The wheels are controlled by a pair of hand actuated levers in the operator control area, while boom control is convertible between a foot actuated control lever in the operator control area and a hand operated element pivotally operative on one of the hand actuated levers. A bucket or other attachments mountable on the boom structure is also powered by hydraulics that are readily convertible between foot or hand operated control mechanisms.

3 Claims, 6 Drawing Sheets

CONTROLS FOR A SKID STEER LOADER

FIELD OF THE INVENTION

The present invention relates generally to front end loaders and more particularly to the operator controls for lifting the boom and curling the bucket of a skid steer loader.

BACKGROUND OF THE INVENTION

Over the years skid steer loaders have been known as agile, compact vehicles with a high degree of maneuverability and a wide range of applications in the agricultural, industrial and construction fields. Exemplary of this type of vehicle is the utility loader depicted in Sperry New Holland publication No. 31653524-12-74 L.V.O. (1975), entitled "Sperry New Holland Utility Loaders". These vehicles usually include an engine, a boom assembly and an operators compartment mounted on a frame supported by four wheels. Coupled to the engine are a main drive system and a lift system for the boom assembly. The vehicle is maneuvered by driving the wheels on one side at a different speed and/or in a different direction from those on the other side resulting in a turning motion, the severity of which is determined by the relative speeds.

Typically the engine, which is rear mounted for counterbalancing effect, drives a pair of hydrostatic pumps coupled to left and right mounted hydrostatic motors. Wheels on the left and right sides of the vehicle are driven by the left and right mounted motors through gears, chains and sprockets. In one known control arrangement, motion is controlled by an operator seated within the operators compartment by moving a pair of hand operated control levers which are linked to the pumps. The extent to which each lever is moved in a forward direction from a neutral position controls the amount of fluid supplied in a forward direction to its respective motor, and therefore the speed at which the wheels on that side of the vehicle will rotate. Similarly, the extent to which a lever is moved in the reverse direction from the neutral position will control the speed at which the associated wheels rotate in the reverse direction.

As mentioned above, skid steer loaders include a boom assembly. This assembly generally comprises a pair of lift arms pivotally mounted to the main frame, or a support frame extending upwardly from the main frame. Attachments are usually mounted to the front of the lift arms. A separate hydraulic system is used to actuate the boom assembly via hydraulic lift cylinders which drive the lift arms. This system is also used to actuate one or two tilt cylinders which pivot the attachment with respect to the lift arms. In the control arrangement mentioned above, a pair of foot pedals in the front of the operator compartment control the flow of hydraulic fluid from a hydraulic pump to the lift and tilt cylinders.

In addition to material handling buckets, various other attachments such as snow blowers, trenchers, tree spades and augers which include their own hydraulic motors are commonly mounted to the boom assembly. An auxiliary hydraulic system is used to control the flow of hydraulic fluid between the hydraulic pump and the hydraulic motor of the front mounted attachment. It is common in prior art systems, using the arrangement mentioned above, for the flow of hydraulic fluid to the motor to be controlled by an auxiliary spool valve through actuation of a handle on one of the control levers. The handle is normally biased to a neutral position. Pushing the handle in one direction strokes the auxiliary valve in a first direction, thereby causing hydraulic fluid to flow to the front mounted attachment in a first direction. Pushing the handle in the opposite direction strokes the auxiliary valve so as to supply fluid in a reverse direction.

In another known control arrangement flow of hydraulic fluid to the lift and tilt cylinders is controlled by a pair of handles on the control levers. Movement of one handle relative to its respective lever controls the boom lift cylinders and movement of the other handle relative to its respective lever controls the bucket tilt cylinders. In this arrangement, if an auxiliary hydraulic system is used for controlling a hydraulic motor or cylinder for mounted attachments, then a foot pedal is utilized for operator actuation.

Over the years, operators have become accustomed to one or the other arrangements, i.e., either using hand controls or foot controls to operate the bucket tilt and boom lift functions of skid steer loaders. In fact the method of operation becomes second nature and operators are reluctant to change to a different machine if it uses an arrangement with which they are not familiar. This becomes a problem for rental and leasing companies in that it requires that they stock different machines to be sure they can satisfy a broader customer base.

In all known prior art apparatus of which applicants are aware there is no simple, convenient system for quickly converting a skid steer loader foot control arrangement to a hand control arrangement, and visa-versa, to satisfy the demands of experienced operators.

SUMMARY OF THE INVENTION

An important object of the present invention is to provide a simple and convenient method and apparatus for converting the controls of a skid steer loader between hand and foot actuated arrangements in a quick and reliable manner.

In pursuance of this and other important objects the present invention is directed to an improvement to a skid steer loader comprising a main frame supported on four wheels, an operator cab mounted on the main frame and including side walls extending upwardly from such main frame to define an operator control area, a boom structure comprising a pair of arms and a mounting assembly, the arms being supported on the frame by the mounting assembly, an engine, first control means operatively coupling the engine to the wheels for propelling the loader, and second control means operatively coupling the engine to the boom structure for raising and lowering the pair of arms, the first control means including hand actuated levers in the operator control area for controlling transmission of power to the wheels, the second control means including a foot actuated lever in the operator control area for controlling hydraulic circuit means for powering the boom. More particularly the present invention contemplates an improvement wherein means are provided for converting control of the boom from the foot actuated lever to a hand operated element pivotally operative on one of the hand actuated levers. Further, another aspect of the invention contemplates a second foot actuated lever for controlling the hydraulic circuit means to move the bucket relative to the boom and means for converting such control of the bucket from the foot actuated lever to a second hand operated element pivotally operative on the other hand actuated lever.

The foregoing and other objects, features and advantages of the invention will appear more fully hereinafter from a consideration of the detailed description which follows, in conjunction with the accompanying sheets of drawings wherein one principal embodiment of the present invention is illustrated by way of example. It is to be expressly understood, however, that the drawings are for illustrative purposes and are not to be construed, as defining the limits of the invention.

DESCRIPTION OF THE PREFERRED EMBODIMENT

Figure 1:
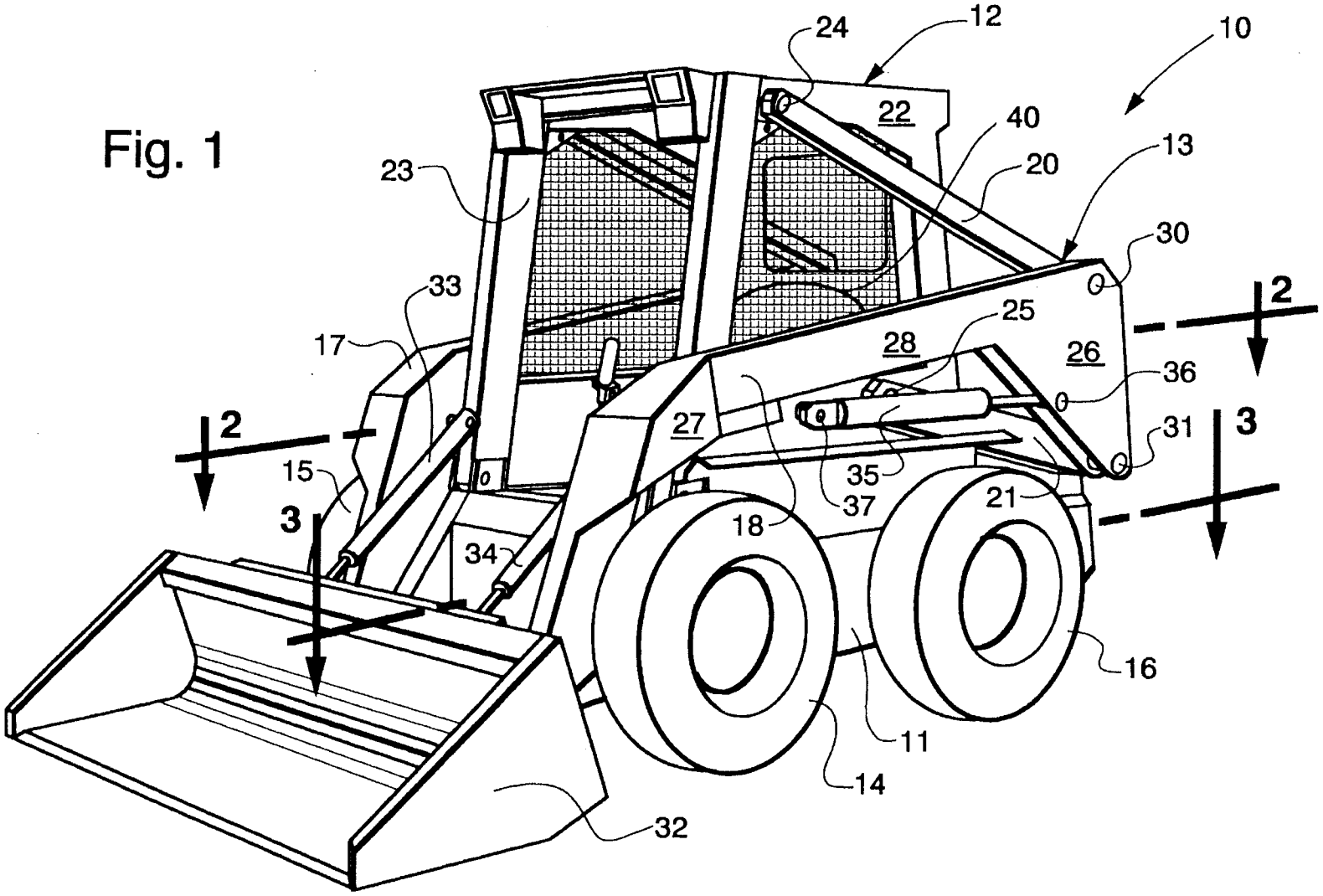
FIG. 1 is a perspective view taken from the left front of a skid steer loader on which the present invention is readily carried out.

Referring now to the drawings for a more detailed description of the present invention, FIG. 1 shows a skid steer loader 10, which utilizes a four bar linkage system of the type generally disclosed in U.S. Pat. No. 3,215,292, issued Nov. 2, 1965 in the name of L. M. Halls, hereby incorporated by reference. Loader 10 includes a main frame 11, a cab 12 and a boom assembly 13, all of which are supported by a pair of front wheels 14, 15 and a pair of rear wheels (only the left one of which, designated by reference numeral 16, in shown in FIG. 1) mounted on axles (not shown) extending from main frame 11.

A pair of lift arms 17, 18 are swingably mounted via upper links 20 and lower links 21 to load supporting side walls 22, 23 of cab 12 via pivots 24 and 25, respectively. For convenience, because the elements on one side of skid steer loader 10 are paired with similar elements on the other side, only one side of the boom assembly mounting structure will be described in most instances in the following description. Each lift arm, comprising a rear portion 26, a forward portion 27 and an intermediate integral portion 28, accommodates upper link 20 and lower link 21 at pivots 30 and 31, respectively, in the rear portion 26 thereof.

Pivotally mounted to the forward portion 27 of lift arms 17, 18 is an attachment such as a material handling bucket 32 which is rotated with respect to the lift arms in a known manner by means of hydraulic tilt cylinders 33, 34. The entire boom assembly 13 and bucket 32 are raised and lowered by means of a pair of hydraulic cylinders 35, each of which is pivotally mounted to the rear portion 26 of lift arm 17 at a pivot 36 and side wall 22 at pivot 37.

Figure 2:
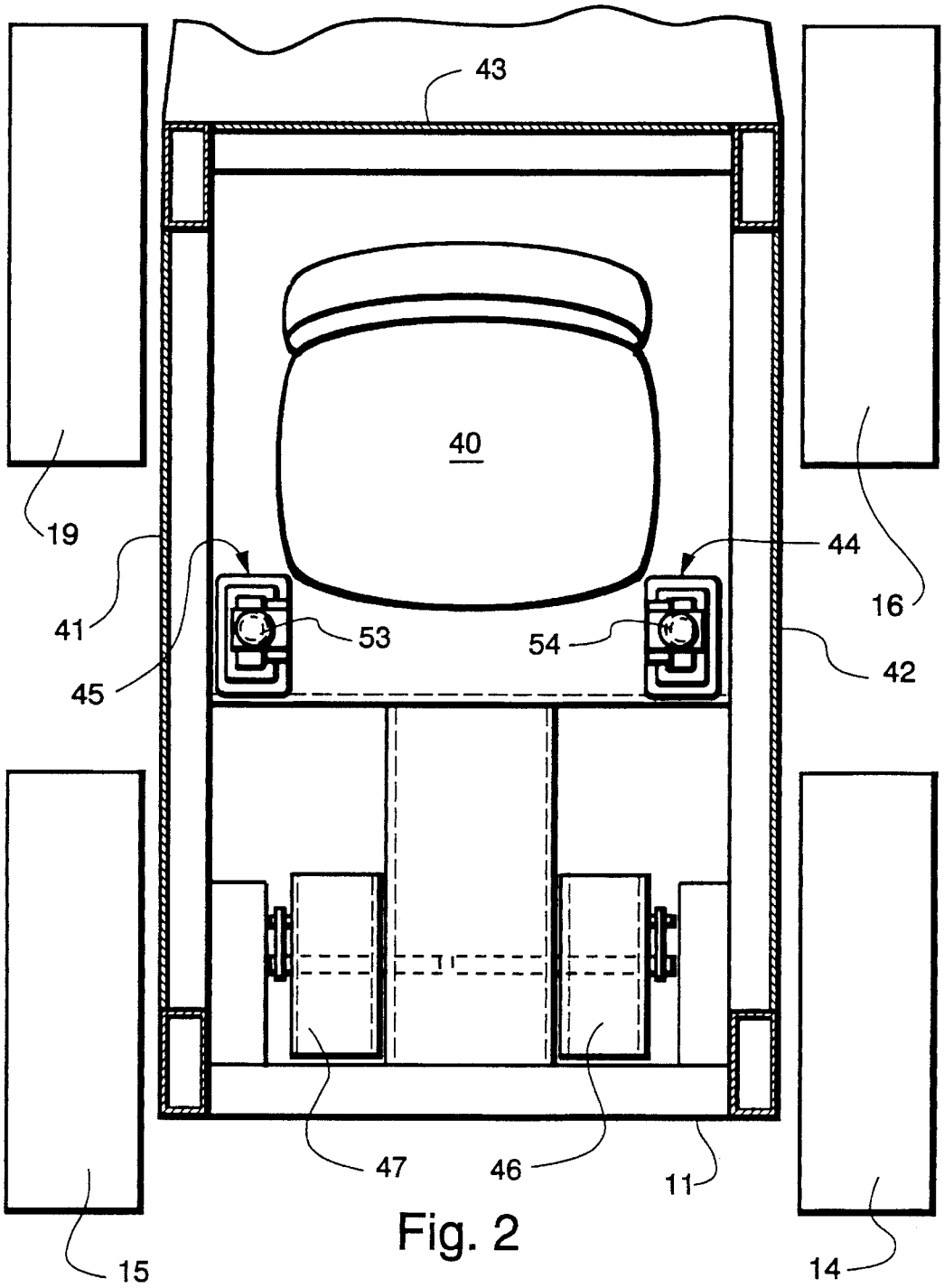
FIG. 2 is a view taken in the direction of arrows 2—2 in FIG. 1.

An operator's seat 40 (FIG. 2), enclosed within cab 12 by side walls 41, 42 and rear wall 43, is mounted for convenient access to left and right hand control assemblies 44, 45 and left and right foot pedals 46, 47. The hand control assemblies are coupled to hydrostatic pumps 48, 50 (FIGS. 3 and 4) which are driven by engine 51. Pump 48 is coupled to a hydrostatic motor (not shown) for driving wheels 15 and 19 via a gear, chain and sprocket arrangement (also not shown) and pump 50 is coupled to another hydrostatic motor for driving wheels 14 and 16 in a similar manner. Control rods 51, 52 are operatively coupled to control assemblies 44, 45 for reciprocation in response to fore and aft motion of control levers 53, 54. This fore and aft reciprocation is translated to pivotal motion of transmission control arms 55, 56 which in turn controls the respective hydrostatic pumps in a well known manner.

Figure 3:
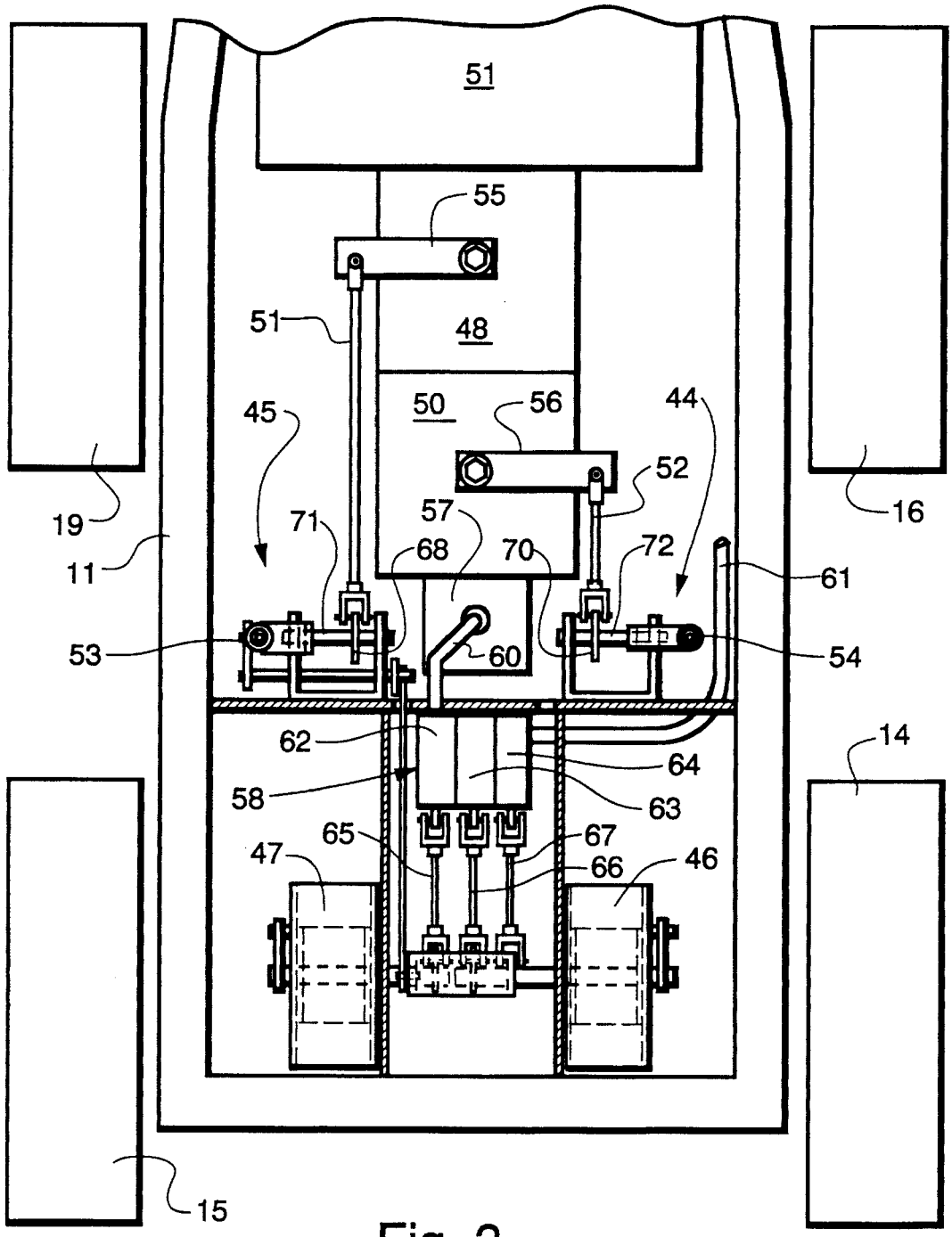
FIG. 3 is a view taken in the direction of arrows 3—3 in FIG. 1.

FIG. 3 shows a hydrostatic gear pump 57 coupled to a three spool control valve 58 via a supply line 60. A return line 61 connects the valve to various other standard hydraulic circuitry elements not shown. Valve 62 controls flow to cylinders 33, 34 to tilt material handling bucket 32, i.e., rotates the bucket with respect to the lift arms of the boom assembly. Valve 63 controls flow to cylinders 35 to lift or lower the boom assembly, and valve 64 controls flow to the auxiliary hydraulic system mentioned above, i.e., controls the flow of hydraulic fluid to a remote hydraulic motor or cylinder for operating various optional attachments or accessories. The position of the spool in valve 62 is determined by the position of reciprocating rod 65 and likewise the position of the spools in valves 63 and 64 are determined by the respective positions of reciprocating rods 66 and 67.

Figure 5:
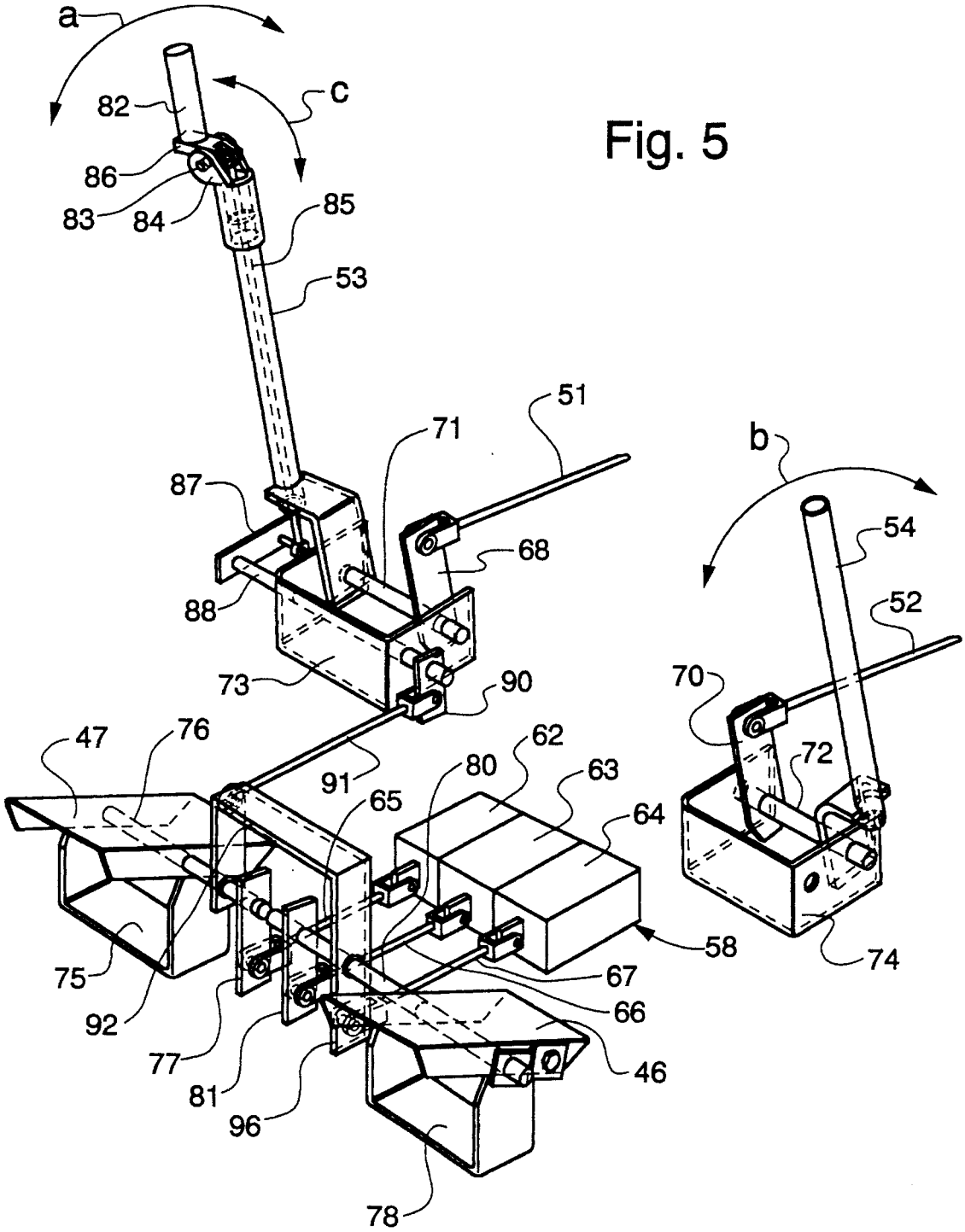
FIG. 5 is a diagrammatic perspective view of the control arrangement shown in FIG. 3.

The actual control of rods 65, 66 and 67 is best described by referring to the diagrammatic perspective view in FIG. 5 which shows the operative relationship of control levers 53, 54, foot pedals 46, 47 and three spool valve 58. It should be noted that the fore and aft operation of control levers 53, 54 illustrated by arrows a and b has no relationship to valve 58. Control rods 51, 52 reciprocate with their respective control levers 53, 54 by virtue of coupling via pivot arms 68, 70, affixed to rods 71, 72, pivotally mounted in stationary brackets 73, 74. With respect to valves 62 and 63, pivotal motion of foot pedal 47 causes reciprocation of rod 65 and pivotal motion of foot pedal 46 causes reciprocation of rod 66.

More specifically, when pedal 47 pivots on support 75, interconnecting rod 76, which is affixed to the pedal also rotates. This swings arm 77, which is also secured to interconnecting rod 76, causing rod 65 to reciprocate in conjoint movement with pedal 47, interconnecting rod 76 and arm 77, and thereby move the spool of valve 62 in response to the position of pedal 47. Similarly, pedal 46, mounted on support 78, moves the spool of valve 63 by rotating interconnecting rod 80 to swing arm 81 and thereby reciprocate rod 66. It should be noted that although both pedals rotate about a common axis, their respective interconnecting rods are independent of each other.

Control of valve 64 is accomplished by moving handle 82 about pivot pin 83 extending between the ears of yoke member 84 attached to the upper end of hollow control lever 53. A rod 85 attached to handle bracket 86 reciprocates in control lever 53 and urges leg 87 up or down in response to the direction in which handle 82 is moved. Leg 87 is affixed to rod 88, which is pivotally mounted in stationary bracket 73, while leg 90, also affixed to rod 88 is pivotally attached to rod 91. A U-shaped pivot link 92, supported on interconnecting rods 76 and 80, which are journalled therein, is also pivotally connected to rod 91. Thus, motion of handle 82 moves rod 85 which in turn rocks interconnected legs 87, 90 causing rod 91 to rotate pivot link 92 about the axis of interconnecting rods 76, 80, resulting in reciprocal motion of rod 67 to control the position of the spool in valve 64.

Figure 6:
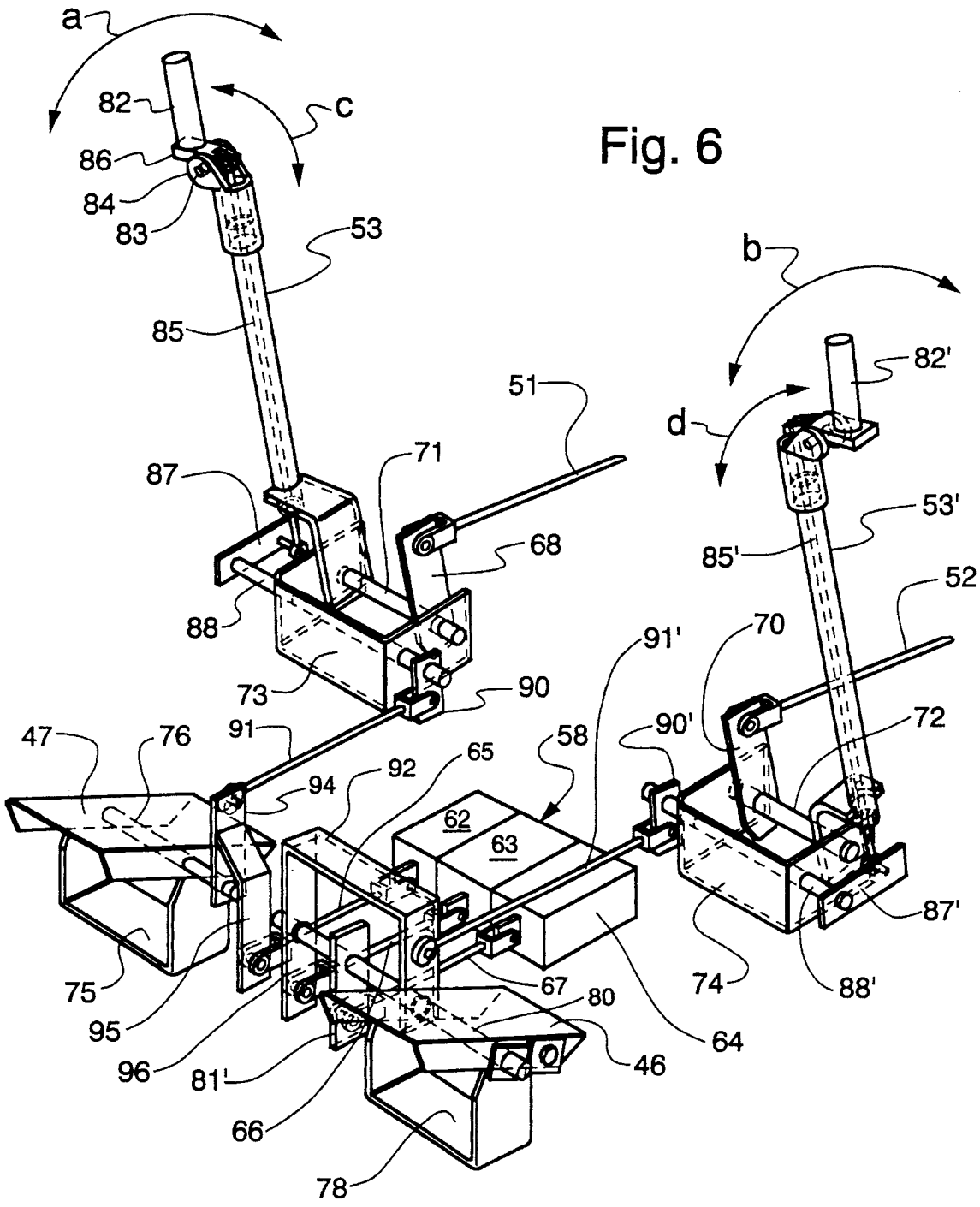
FIG. 6 is a diagrammatic perspective view of the control arrangement shown in FIG. 4.

Now, turning to FIG. 6 which illustrates the crux of the present invention, the valves controlled by the foot pedals in the above described arrangement are quickly and conveniently converted to hand controls via a novel system which utilized most of the elements of the first arrangement in a different configuration while adding a few new elements which are similar or identical to those already used. Valve 62 is controlled by handle 82, i.e., when rod 91 is reciprocated in response to motion of handle 82 along a path illustrated by arrow c, arm 94 affixed to a bracket 95 causes rod 65 to move the spool of valve 62. Rod 66 associated with valve 63 is now actuated by pivotal motion of the extending leg portion 96 of pivot link 92 which is now mounted solely on interconnecting rod 80, which is journalled in two locations therein. Pivot link 92 is rotated about interconnecting rod 80 in response to motion of handle 82' along a path illustrated by arrow d. In a manner not unlike the motion of handle 82, handle 82' moves link 91', which is pivotally connected to pivot link 92.

Figure 4:
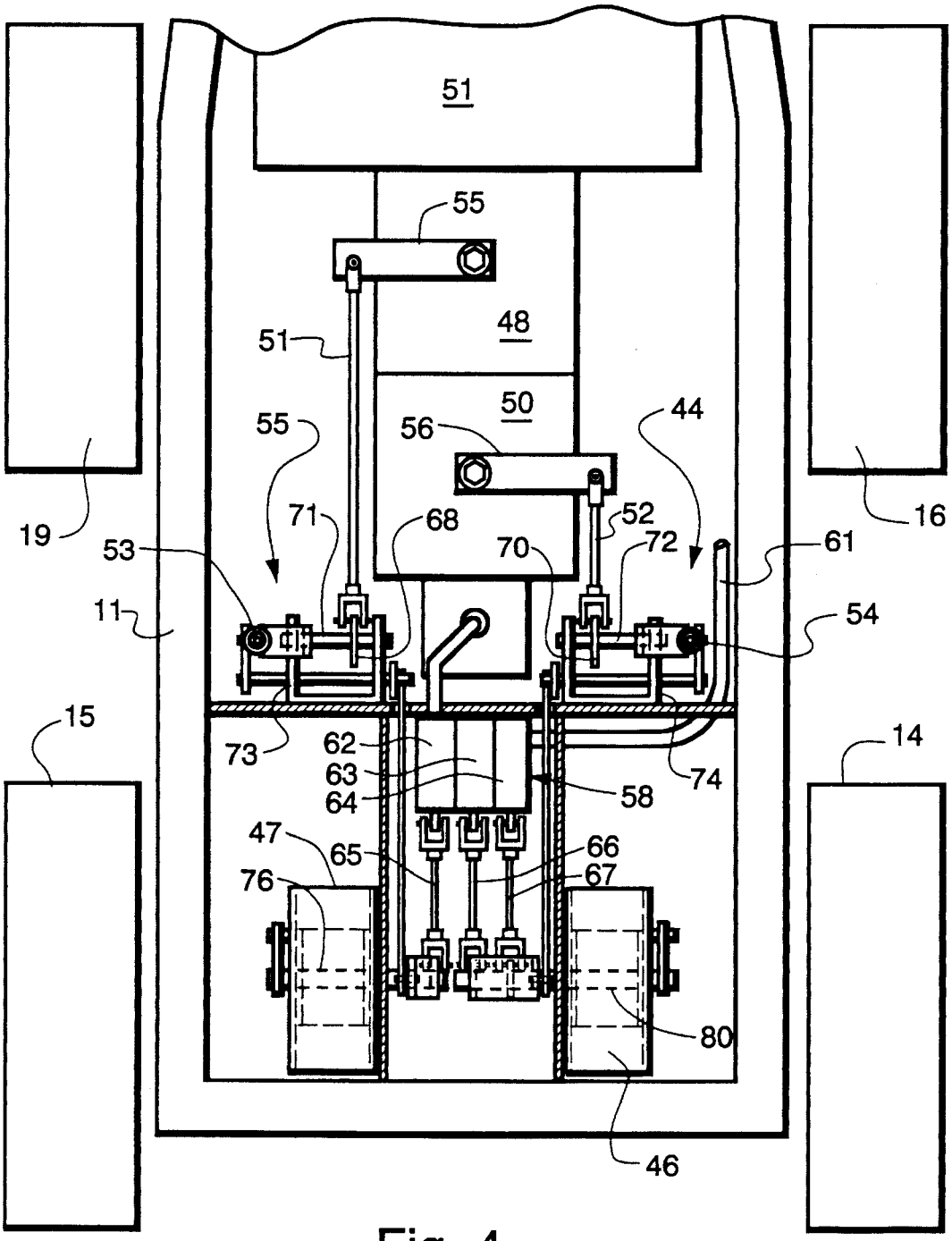
FIG. 4 is a view similar to the view shown in FIG. 3 and includes a modification to the control arrangement.

Lastly, in the converted arrangement shown in FIGS. 4 and 6, valve 64, which is used to control accessories via a remote hydraulic motor or the like, is controlled by foot pedal 46 via rod 67, now pivotally coupled to arm 81', connected to interconnecting rod 80.

Of the many implicit and explicit advantages of the present invention one of the most important is the provision of a unique conversion system allowing for operation of the boom and bucket of a skid steer loader with either hand or foot controls with a minimum of effort and while utilizing many common parts. Further, in view of the simplicity of the system, there is inherently a reduction in the cost and required time for conversion which improves the productivity and efficiency of the servicing organization. Still further, by using mechanical linkages, in addition to the cost advantage, reliability and simplicity, there is inherent advantages when compared to other known means such as cable which tends to stretch and wear in arcuate areas.

While preferred structure in which the principles of the present invention are shown and described above, it is to be understood that the invention is not limited to such structure, but that, in fact, widely different means of varying scope and configuration may be employed in the practice of the invention.

Having thus described the invention, what is claimed is:

1. A control system for a skid steer loader having a main frame supported on four wheels, an operator cab mounted on said main frame, said cab including side walls extending upwardly from said main frame to define an operator control area therebetween, a boom structure comprising a pair of arms and a mounting assembly, said arms supported on said frame by said mounting assembly, power means comprising an engine, first hydraulic means operatively coupling said engine to said wheels for propelling said loader at varying speeds in forward and reverse, second hydraulic means operatively coupling said engine to said boom structure for raising and lowering said pair of arms, said system comprising a multi-spool directional control valve comprising a plurality of operative spool valves associated with a like plurality of forwardly extending control rods, each of which controls a particular spool valve, first and second hand actuated levers in said operator control area coupled to said first hydraulic means for controlling the direction and speed of said wheels, a pair of pivotable foot pedals in said operator control area forward of said hand actuated levers, said pedals pivotable about an axis extending transversely and forward of said multi-spool directional control valve, a hand actuated element operative on one of said hand actuated levers, said element pivotable relative to said one of said levers, first mechanical linkage means for coupling said hand actuated element to the control rod associated with one of said plurality of spool valves, whereby manipulation of said element reciprocates said control rod, second mechanical linkage means for coupling one of said foot pedals to a second control rod associated with a second of said plurality of spool valves, whereby manipulation of said one of said foot pedals reciprocates said second control rod, said first mechanical linkage means includes an arm pivotally attached to said control rod, said arm mounted to pivot about said axis to reciprocate said rod under conditions where said element is manipulated, and said second mechanical linkage means includes a second arm pivotally attached to said second control rod, said second arm also mounted to pivot about said axis to reciprocate said second rod under conditions where said one of said foot pedals is manipulated.

2. A control system for a skid steer loader having a main frame supported on four wheels, an operator cab mounted on said main frame, said cab including side walls extending upwardly from said main frame to define an operator control area therebetween, a boom structure comprising a pair of arms and a mounting assembly, said arms supported on said frame by said mounting assembly, power means comprising an engine, first hydraulic means operatively coupling said engine to said wheels for propelling said loader at varying speeds in forward and reverse, second hydraulic means operatively coupling said engine to said boom structure for raising and lowering said pair of arms, said system comprising a multi-spool directional control valve comprising a plurality of operative spool valves associated with a like plurality of forwardly extending control rods, each of which controls a particular spool valve, first and second hand actuated levers in said operators control area coupled to said first hydraulic means for controlling the direction and speed of said wheels, a pair of pivotable foot pedals in said operator control area forward of said hand actuated levers, said pedals pivotable about an axis extending transversely and forward of said multi-spool directional control valve, a hand actuated element operative on one of said hand actuated levers, said element pivotable relative to said one of said levers, a second hand actuated element operative on the other of said hand actuated levers, said second element pivotable relative to said other of said levers, first mechanical linkage means for coupling said hand actuated element to the control rod associated with one of said plurality of spool valves, whereby manipulation of said element reciprocates said control rod, second mechanical linkage means for coupling one of said foot pedals to a second control rod associated with a second of said plurality of spool valves, whereby manipulation of said one of said foot pedals reciprocates said second control rod, third mechanical linkage means for coupling said second hand actuated element to a third control rod associated with a third of said plurality of spool valves, whereby manipulation of said second element reciprocates said third control rod, said first mechanical linkage means includes an arm pivotally attached to said control rod, said arm mounted to pivot about said axis to reciprocate said rod under conditions where said element is manipulated, said second mechanical linkage means includes a second arm pivotally attached to said second control rod, said second arm also mounted to pivot about said axis to reciprocate said second rod under conditions where said one of said foot pedals is manipulated, and said third mechanical linkage means includes a third arm pivotally attached to said third control rod, said third arm also mounted to pivot about said axis to reciprocate said third rod under conditions where said second element is manipulated.

3. In a control system for a skid steer loader having a main frame supported on four wheels, an operator cab mounted on said main frame, said cab including side walls extending upwardly from said main frame to define an operator control area therebetween, a boom structure comprising a pair of arms and a mounting assembly, said arms supported on said frame by said mounting assembly, power means comprising an engine, first hydraulic means operatively coupling said engine to said wheels for propelling said loader at varying speeds in forward and reverse, second hydraulic means operatively coupling said engine to said boom structure for raising and lowering said pair of arms, said system comprising a multi-spool directional control valve comprising a plurality of operative spool valves associated with a like plurality of forwardly extending control rods, each of which controls a particular spool valve, first and second hand actuated levers in said operator control area coupled to said first hydraulic means for controlling the direction and speed of said wheels, a pair of pivotable foot pedals in said operator control area forward of said hand actuated levers, said pedals pivotable about an axis extending transversely and forward of said multi-spool directional control valve, a hand actuated element operative on one of said hand actuated levers, said element pivotable relative to said one of said levers, a second hand actuated element operative on the other of said hand actuated levers, said second element pivotable relative to said other of said levers, first mechanical linkage means for coupling said hand actuated element to the control rod associated with one of said plurality of spool valves, whereby manipulation of said element reciprocates said control rod, second mechanical linkage means for coupling one of said foot pedals to a second control rod associated with a second of said plurality of spool valves, whereby manipulation of said one of said foot pedals reciprocates said second control rod, and third mechanical linkage means for coupling the other of said pair of foot pedals to a third control rod associated with a third of said plurality of spool valves, whereby manipulation of said other of said foot pedals reciprocates said third control rod, the method of converting said control system comprising the steps of decoupling said hand actuated element from said control rod associated with one of said plurality of spool valves, decoupling said one of said foot pedals from said second control rod associated with said second of said plurality of said spool valves, decoupling said other of said foot pedals from said third control rod associated with said third of said plurality of said spool valves, coupling said third control rod to said hand actuated element on one of said hand actuated levers, coupling said second control rod to said second hand actuated element operative on the other of said hand actuated levers, and coupling said control rod to said one of said foot pedals.

* * * * *